United States Patent [19]

Baer

[11] Patent Number: 4,966,309

[45] Date of Patent: Oct. 30, 1990

[54] PLAY STRUCTURE HARDWARE KIT

[75] Inventor: Thomas R. Baer, Edgerton, Wis.

[73] Assignee: Newco of Janesville, Inc., Janesville, Wis.

[21] Appl. No.: 390,634

[22] Filed: Aug. 7, 1989

[51] Int. Cl.[5] ..... A63G 9/00

[52] U.S. Cl. ..... 272/85; 248/165; 256/64; 403/217

[58] Field of Search ..... 403/219, 217, 403; 256/64; 248/165; 182/224; 272/85

[56] References Cited

U.S. PATENT DOCUMENTS

| | | | |
|---|---|---|---|
| 3,480,111 | 11/1969 | Larson | 182/224 |
| 3,656,581 | 4/1972 | Larson | 182/224 |
| 3,854,268 | 12/1974 | Gutner | 403/403 |
| 3,871,784 | 3/1975 | Van Horn . | |
| 3,893,776 | 7/1975 | Beattie . | |
| 3,969,871 | 7/1976 | Ewers . | |
| 4,014,540 | 3/1977 | Caulkins . | |
| 4,337,941 | 7/1982 | Kitka . | |
| 4,796,884 | 1/1989 | Ely et al. . | |

FOREIGN PATENT DOCUMENTS

| | | | |
|---|---|---|---|
| 511306 | 5/1952 | Belgium | 182/224 |

OTHER PUBLICATIONS

"Do It Yourself Swing-N-Slide Plan And Guide" booklet, copyright 1986, Newco Engineering.

"Do It Yourself Swing-N-Slide" brochure.

*Primary Examiner*—Andrew V. Kundrat

*Attorney, Agent, or Firm*—Lathrop & Clark

[57] ABSTRACT

A kit for assembling timbers into a play structure is disclosed. The kit includes a frame bracket which has a frame segment joined at a right angle to a beam segment. The frame segment has four nail or screw holes and the beam segment has two nail or screw holes. The beam segment has a square bolt hole for receiving a carriage bolt. The frame segment is adapted to joining two timbers into an A-frame so formed to a transverse overhead laminated beam. The kit also has a frame brace with a body plate having a flange joined to it at such an angle that when the body is placed flat on the A-frame, the flange lies flat on the beam. The frame brace has nail or screw holes and bolt holes in both the body and the flange. The kit also contains rectangular flat beam clamps adapted to attachment across the laminations of the beam so as to restrict the separating of the laminations. The beam clamps have at least two nail holes and a central bolt hole. The bolt hole being circular on the beam clamp for use with the frame bracket and oblong for use with a swing hanger.

6 Claims, 3 Drawing Sheets

PLAY STRUCTURE HARDWARE KIT

FIELD OF THE INVENTION

This invention relates to hardware for connecting wooden members in rigid relation in general and to hardware for assembling a children's play structure in particular.

DESCRIPTION OF THE PRIOR ART

Play structures for the entertainment and exercise of children have long been in use. Particularly popular with children has been the swing set which consists of an overhead beam supported on opposite ends by frame members with chairs or seats depending from the overhead member on chains or ropes. Swing sets or other play structures may be constructed of metal or plastic, but metal is costly and prone to rust, and plastic tends to lack the necessary strength to stand up to heavy use by children. Swing sets may also be constructed from modern weather-resistent treated timber which is strong and durable and does not require painting. Wooden sets present a rugged and attractive appearance and are not subject to rusting.

Because of the bulk and weight of assembled play structures they are rarely shipped from the manufacturer in assembled form, but are often sold as kits for home assembly by the consumer. Milled lumber of standard dimensions is readily available to most consumers, so wooden play structure kits often require the consumer to supply his own lumber; this results in reduced shipping costs to the manufacturer and a lower price to the consumer.

A play set constructed by the consumer from standard dimensioned lumber can be much less costly than a pre-cut or assembled model. However, although the materials are inexpensive, because the swing set features the intersection of a number of angled beams, fabrication of swing sets from standard timber lengths without specialized hardware has been restricted to professional carpenters and skilled hobbyists. A play set must be rigidly braced and the structure must be capable of withstanding loads in addition to those due to the swinging motions of the suspended seats.

All-wood playsets have long been known to the art, but wood joinery requires advanced carpentry skill. Previous hardware kits for constructing wooden play sets are also known.

In order to extend the benefits of healthful outdoor play to children of parents of all income and skill levels there is needed a system for erecting a swing set or play structure that requires only rudimentary woodworking skills and tools and yet that is still sufficiently stiff.

SUMMARY OF THE INVENTION

The kit for assembling timber and fasteners into a play structure of this invention consists of frame brackets, frame braces, and two types of beam clamp. The frame brackets of the kit have a frame segment joined at substantially a right angle to a beam segment. There are four or more nail holes in the frame segment and two or more nail holes in the beam segment. Furthermore, the beam segment has a square bolt hole. The bracket has inclined sides which serve as a template for cutting the cross beam members of the A-frame.

The frame braces of the kit have a body and a flange rigidly joined to the body at such an angle that when the body is placed flat on the A-frame, the flange lies flat on the beam. Both the body and the flange have two or more nail holes as well as two or more bolt holes.

The beam clamps of this kit have two or more nail holes and a central bolt hole.

It is an object of this invention to provide a kit for constructing a play structure from standard size lumber.

It is an also an object of this invention to provide hardware for joining an A-frame to a beam in a rigid manner.

It is a further object of this invention to provide a kit for constructing a play structure that may be assembled by an unskilled consumer.

Other objects, advantages and features of the present invention will become apparent from the following specification when taken in conjunction with the accompanying drawings.

DESCRIPTION OF THE PREFERRED EMBODIMENT

Figure 1:
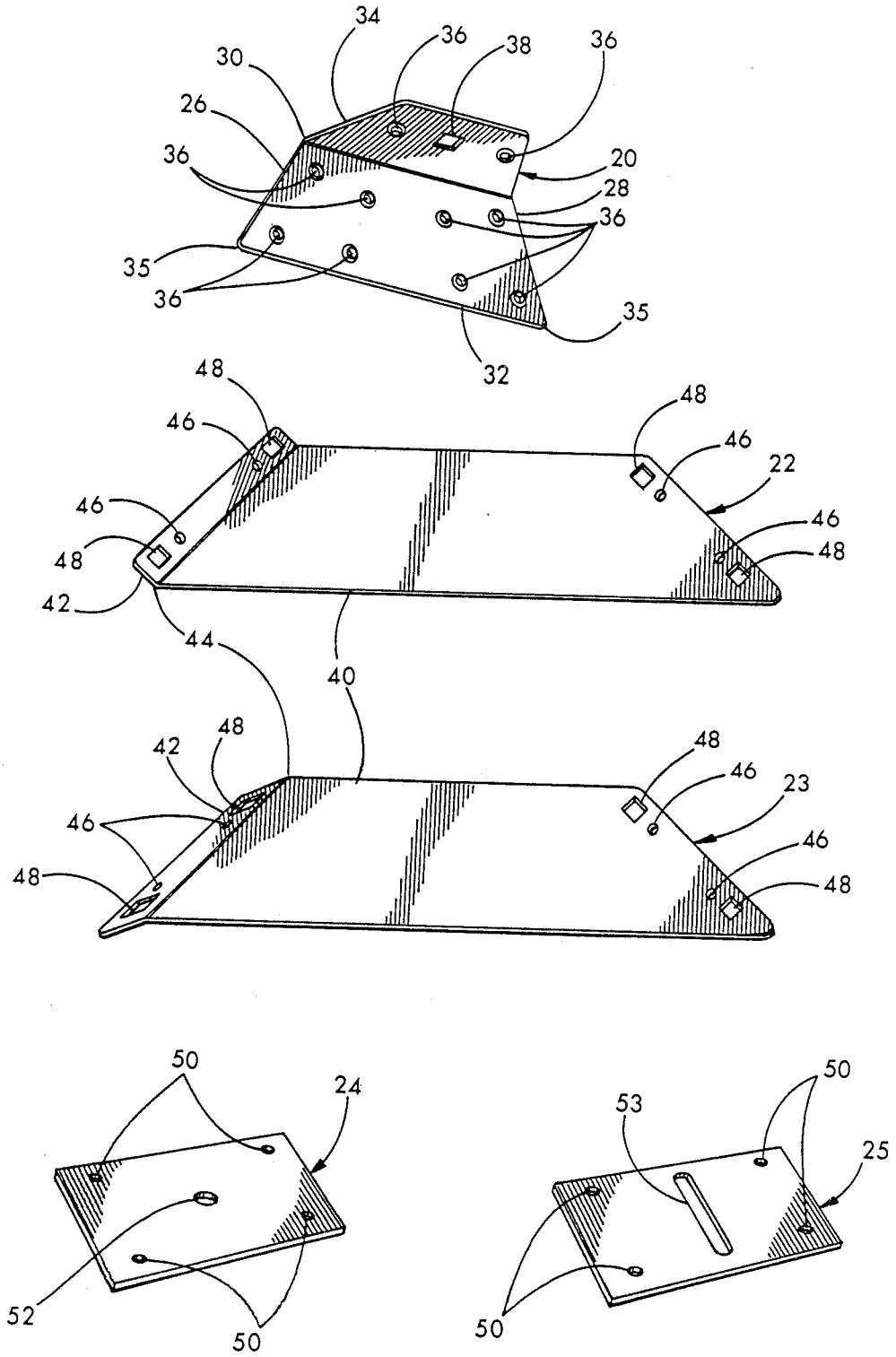
FIG. 1 is a perspective view of a kit for assembling a children's play structure.

Referring more particularly to FIGS. 1–5 wherein like numerals refer to similar parts, the kit of FIG. 1 consists of frame brackets 20, frame braces 22, 23 and beam clamps 24, 25. These parts may be formed from any rigid metallic substance but are preferably stamped from galvanized sheet steel such as 14-gauge galvanized steel.

The frame bracket 20 is a quadrilateral plate with inwardly inclined sides 26, 28. The frame bracket 20 is bent along bend line 30 to form a frame segment 32 and a beam segment 34 at substantially right angles to one another. A number of nail or screw holes 36 are drilled, cut or preferably stamped through the frame and beam segments 32, 34 of the frame bracket 20. The number of nail holes 36 may vary depending on the size and sturdiness of the timbers to be connected, but there should be at least four and preferably eight nail holes 36 in the frame segment 32, and at least two nail holes 36 in the beam segment 34. In the center of the beam segment 34 there is located a square bolt hole 38 suitable for allowing the passage of the shank of a carriage bolt, yet sized to lock about the square portion of the bolt head. The corners 35 of frame segment 32 are radiused. The nail holes 36 in the frame bracket 20 are surrounded by an upraised crown, so that screws may be used which will leave no protruding head.

The frame braces 22, 23 have a body 40 and a flange 42. The flange 42 is bent along bend line 44 to make either a frame brace 22 with an upwardly bent flange or a frame brace 23 with a downwardly bent flange. The flanges 42 are bent at such an angle that when the body 40 is placed flat on the A-frame 62 described below, the flange 42 lies flat on the beam 64. There are two nail holes 46 cut, drilled, stamped or punched in the flange 42. There are also two nail holes 46 in the body 40 on the edge of the body opposite the flange 42. Bolt holes 48 are placed in close spaced relation to each nail hole. The bolt holes 48 are preferably square to capture carriage bolts.

The beam clamp 24 is a rectangular plate preferably with four nail holes 50 and with one bolt hole 52 in the center of the beam clamp 24. The bolt hole 52 is circular in the beam clamp 24 that is assembled in conjunction with the frame bracket 20. The bolt hole 53 is an oblong slot in the beam clamp 25 adapted to locking a swing hangar in place. Due to the design of the hardware of the kit of this invention, the assembler of the play structure 54 needs only a saw, a hammer, a drill, a tape measure and an adjustable wrench. No advanced woodworking or joinery equipment is needed.

Figure 2:
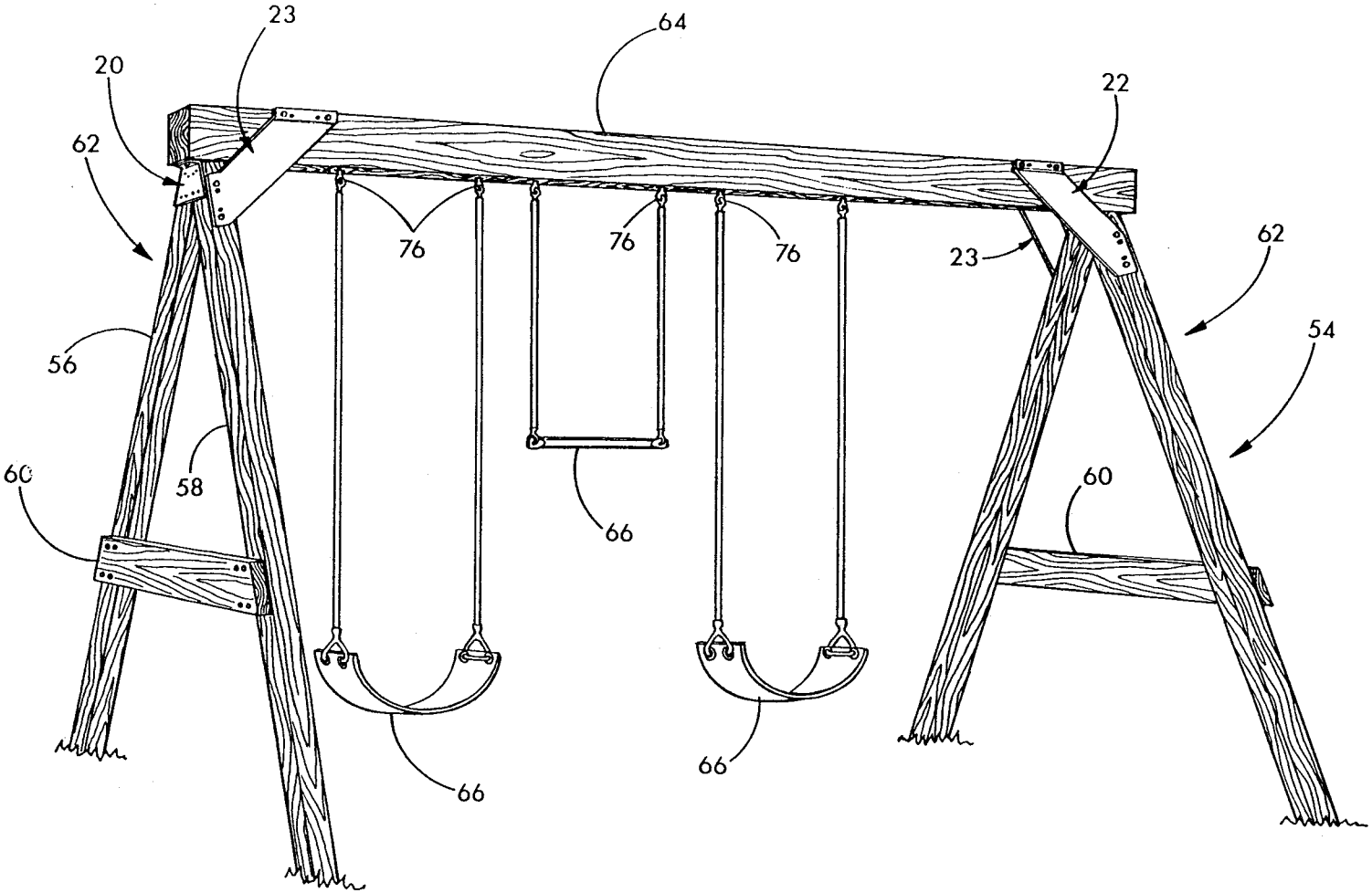
FIG. 2 is a perspective view of a play structure assembled from the kit in FIG. 1.

A play structure 54 as in FIG. 2 may be constructed using the elements of this kit in the following manner. First the lumber is cut to size. The timber members 56, 58 that will form the A-frame are cut to size with straight cuts. The timber that will form the cross members 60 is cut off at an angle, using the sides 26, 28 of the frame bracket 20 as templates; so that the corners of the members 60 will not project beyond the inclined sides of the A-frame. Next, two timber members 56, 58 are laid on a flat surface with two ends together to form a "V". The frame bracket 20 is laid over the ends of the members 56, 58 and the inclined sides 26, 28 are used to align and position the wooden members 56 and 58. When the timber members are properly positioned nails or self-tapping screws are driven through the nail holes 36 in the frame segment 32 of the frame bracket 20 into the wooden members 56, 58. The frame bracket and member assembly is then turned over and a second frame bracket 20 is nailed or screwed into place on the opposite side of beams 56 and 58 in spaced relation to the first frame bracket 20. In this way the timber members are securely fastened together to form an A-frame without the need for joining the timbers end-to-end in a precise joint. No miter cuts are needed, because the members 56, 58 do not directly contact one another. A cross member 60 is then nailed into place midway along the length of the members 56, 58. The resultant assembly of the cross member 60, the members 56, 58 and the two frame brackets 20 is an A-frame 62. After the first A-frame 62 has been assembled, a second A-frame 62 identical to the first is assembled.

The beam 64 must span the length of the play structure and support the various swings 66. Therefore the beam 64 must be particularly stiff and sturdy. The beam 64 is preferably of substantially square cross section and formed of a single 4×6 or 5×5 beam. However, beams of this type are not always readily available to the amateur carpenter. Therefore a laminated beam may be constructed by gluing up and by nailing together two or more 2×6 timbers.

To prepare the beam 64 for mounting on the A-frames 62, two vertical bolt holes 68 are drilled inward of the ends of the beam.

Figure 3:
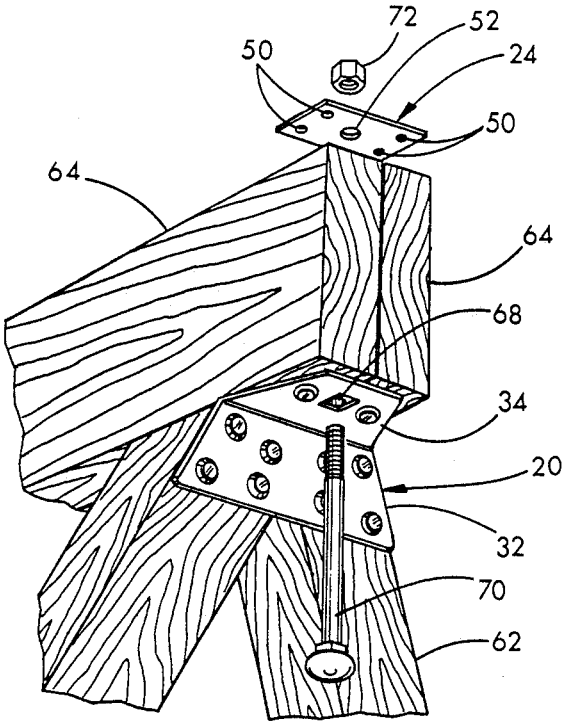
FIG. 3 is a partial exploded perspective view of the frame bracket and frame clamp as installed on a play structure.
Figure 4:
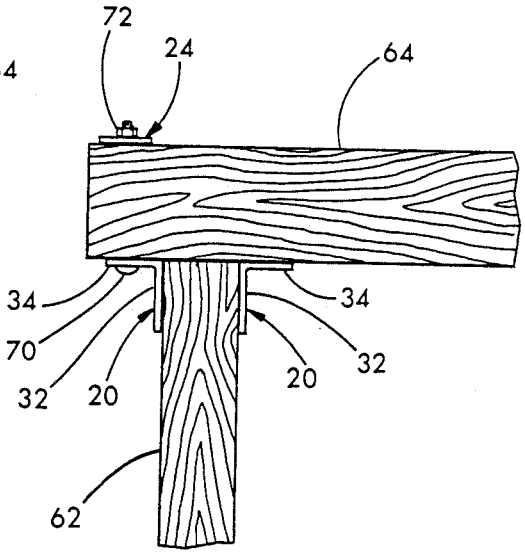
FIG. 4 is a side view of the frame bracket and beam clamp as installed on a play structure.

The beam 64, as may be seen in FIGS. 3 and 4, is then placed on top of the first A-frame 62 resting on the beam segment 34 of the frame bracket 20 with the bolt hole 68 in alignment with the bolt hole 38 of the frame bracket 20. The beam 64 is positioned by driving nails or screws through the nail holes 36 of the beam segment 34 into the beam 64. These nails, one on each side of the bolt hole 68, act to restrain the tendancy of the laminations of the beam 64 to separate under the loads applied. A beam clamp 24 is then placed on top of the beam 64 with the bolt hole 52 of the beam clamp 24 in alignment with the square bolt hole 68 of the beam 64 and with the beam clamp 24 running transversely to the laminations of the beam 64. The beam clamp 24 is nailed into place at the nail holes 50, thereby acting as a further check on the separation of the laminations of the beam 64. A carriage bolt 70 is then inserted through the aligned bolt holes 38, 68, 52 and secured with a loc nut 72. The square bolt hole 38 will capture and hold the head of the carriage bolt 70 so the loc nut 72 may be safely and securely tightened. The frame bracket 20 on the opposite side of the A-frame 62 need not be bolted to the beam 64. The effect of the frame bracket 20, beam clamp 24, carriage bolt 70, and fastener assembly is to rigidly clamp together the beam 64 and the A-frame 62 securely and effectively.

Figure 5:
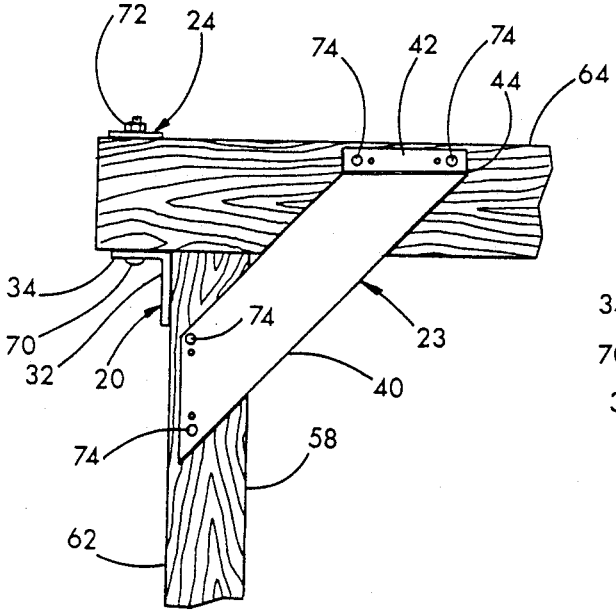
FIG. 5 is a side view of the frame bracket, frame brace, and beam clamp as installed on a play structure.

After the second A-frame 62 has been attached to the beam 64 in the same manner as the first, the play structure 54 is stiffened and the beam 64 is restricted from rotating about the A-frames 62 by the installation of the frame braces 22, 23 as shown in FIG. 5. The first frame brace 23 is positioned with the nail holes 46 of the body 40 on the timber member 58 of the A-frame 62 and with the nail holes 46 of the flange 42 on the beam 64. The brace 23 is initially held in place by driving nails or self-topping screws through the nail holes 46. The beam brace 22 is affixed opposite to the beam brace 23 on the other side of the A-frame 62 and spanning the member 56 and the beam 64. Then beam braces 22, 23 are nailed or screwed in place between the second A-frame 62 and the beam 64. Once all four beam braces 22, 23 have been affixed in this manner, holes are drilled through the bolt holes 48 and through the beam 64 and A-frames 62. Carriage bolts 74 are then inserted into the holes thus drilled and secured with loc nuts. The beam braces act together to unify the individual elements of the play structure 54 into a single rigid assembly which will resist twisting and disassembly under heavy play activity.

Each swing 66 is mounted on the play structure 62 by drilling additional holes in the beam 64 and suspending the swing from conventional swing hangers 76 running through the beam and supported on the top face of the beam 64 by beam clamps 24 and on the bottom face of the beam by beam clamps 25 which capture the hangers 76 in slots 53 and prevent the hangers 76 from rotating.

Using the hardware of the kit of this invention the simple swing set 62 may be constructed. However by combining the hardware from several kits, structures having multiple A-frames attached to a single overhead beam are possible, as well as structures a single A-frame at one end of the beam and a conventional tower structure at the other end of the beam. The beam clamps may be used to suspend other types of hanging play devices than swings. Furthermore, if desired a kit containing pre-cut and pre-drilled lumber could be assembled together with the necessary hardware and fasteners for the play structure.

It is to be understood that the present invention is not limited to the particular construction and arrangement of parts disclosed and illustrated herein but embraces all such modified forms thereof which are within the scope of the following claims.

What is claimed is:

1. A kit for assembling timber and fasteners into a play structure comprising:

(a) at least one frame bracket having a frame segment joined at substantially a right angle to a beam segment, wherein the brackets have portions defining at least four nail holes in the frame segment and at least two nail holes in the beam segment, and wherein the beam segment has portions defining a bolt hole, the frame bracket being adapted to joining an A-frame to a beam;

(b) at least one frame brace having a body and a flange rigidly joined to the body at such an angle that when the body is placed flat on the A-frame, the flange lies flat on the beam; wherein the flange and the body each have portions defining at least two nail holes and at least two bolt holes; and (c) at least one beam clamp having portions defining at least two nail holes and a central bolt hole, the bolt hole being of a dimension adequate to receive a bolt therethrough as does the bolt hole in the frame bracket, the clamp being adapted to attachment across the laminiations of a laminated beam so as to restrict the separating of the laminations.

2. The kit of claim 1 wherein the frame segment of the frame bracket has inclined sides adapted to serve as a template for cutting a cross piece for a wooden A-frame.

3. The kit of claim 1 wherein the bolt hole defined by the portions of the beam segment of the frame bracket is square.

4. The kit of claim 1 further comprising at least one swing hanger beam clamp having portions defining at least two nail holes and a central bolt hole, the bolt hole being an oblong slot.

5. The kit of claim 1 wherein the portions defining nail holes in the frame bracket define raised crown portions around the nail holes.

6. A play structure comprising:

(a) a wooden horizontal beam;

(b) two wooden A-frames;

(c) wherein each A-frame is formed from two timber members joined at an angle by a frame bracket having a frame segment joined at substantially a right angle to a beam segment, wherein the bracket has portions defining at least four nail holes in the frame segment and at least two nail holes in the beam segment and wherein the frame segment has inclined sides and wherein the beam segment has a bolt hole, the two members being joined by a horizontal cross piece;

(d) wherein one of the A-frames is attached to either end of the beam by a bolt running through the bolt hole of the beam segment and through the beam, and secured on the beam by a beam clamp;

(e) frame braces having a body and a flange rigidly joined to the body at such an angle that when the body is placed flat on the A-frame, the flange lies flat on the beam; and (f) wherein the frame braces are secured by at least one bolt through the body and at least one bolt through the flange of the frame brace on both ends of the beam on both sides of the A-frame.

* * * * *